US012207736B1

(12) United States Patent
Chan

(10) Patent No.: US 12,207,736 B1
(45) Date of Patent: Jan. 28, 2025

(54) SEATING APPARATUS

(71) Applicant: Alexander Chan, Alameda, CA (US)

(72) Inventor: Alexander Chan, Alameda, CA (US)

( * ) Notice: Subject to any disclaimer, the term of this patent is extended or adjusted under 35 U.S.C. 154(b) by 0 days.

(21) Appl. No.: 18/673,367

(22) Filed: May 24, 2024

Related U.S. Application Data

(60) Provisional application No. 63/587,908, filed on Oct. 4, 2023.

(51) Int. Cl.

| | |
|---|---|
| ***A47C 4/04*** | (2006.01) |
| ***A47C 4/08*** | (2006.01) |
| ***A47C 4/10*** | (2006.01) |
| ***A47C 4/18*** | (2006.01) |
| ***A47C 4/20*** | (2006.01) |
| ***A47C 4/28*** | (2006.01) |
| ***A47C 7/02*** | (2006.01) |
| ***A47C 7/24*** | (2006.01) |

(52) U.S. Cl.
CPC ..... *A47C 4/28* (2013.01); *A47C 4/04* (2013.01); *A47C 4/08* (2013.01); *A47C 4/10* (2013.01); *A47C 4/18* (2013.01); *A47C 4/20* (2013.01); *A47C 7/021* (2013.01); *A47C 7/24* (2013.01)

(58) Field of Classification Search
CPC .... A47C 4/04; A47C 4/08; A47C 4/10; A47C 4/18; A47C 4/20
USPC ..... 297/24, 25, 27, 28
See application file for complete search history.

(56) References Cited

U.S. PATENT DOCUMENTS

| | | | | | |
|---|---|---|---|---|---|
| 246,465 | A | * | 8/1881 | Cotton | A47C 1/0265 297/28 X |
| 329,941 | A | * | 11/1885 | Parks | A47C 1/0265 297/28 X |
| 2,042,252 | A | * | 5/1936 | Freedman | A47C 4/40 297/27 |
| RE20,181 | E | * | 11/1936 | Freedman | A47C 4/40 297/27 |
| 2,072,075 | A | * | 2/1937 | Travers | A47C 4/12 297/28 X |
| 2,097,500 | A | * | 11/1937 | Oermann | A47C 4/40 297/27 |
| 2,195,091 | A | * | 3/1940 | Lorenz | A47C 1/035 297/27 X |
| 2,213,590 | A | * | 9/1940 | Parry | A47C 1/0265 297/28 X |

(Continued)

*Primary Examiner* — Rodney B White
(74) *Attorney, Agent, or Firm* — Evergreen Valley Law Group; Kanika Radhakrishnan

(57) ABSTRACT

A seating apparatus includes a seat member, a backrest member pivotally mounted to the seat member, and an armrest frame. The armrest frame includes a left armrest member, a right armrest member, and at least one connecting member pivotally mounted to the backrest member. Further, the seating apparatus includes a front support frame and a rear support frame. The front support frame includes a left front support structure and a right front support structure pivotally mounted to the left armrest member and the right armrest member, respectively. The rear support frame includes a left rear support structure, a right rear support structure pivotally coupled to the left front support structure and the right front support structure, respectively. The pivotal coupling in the seating apparatus facilitates the seating apparatus to be operated in an unfolded condition and a folded condition.

10 Claims, 12 Drawing Sheets

(56) References Cited

U.S. PATENT DOCUMENTS 2,243,502 A * 5/1941 Freedman ..... A47C 1/0265 297/28 X
2,260,735 A * 10/1941 Benjamin ..... A47C 4/40 297/28 X
2,318,067 A * 5/1943 Ebbert ..... A47C 4/30 297/27 X
2,333,761 A * 11/1943 Beeskow ..... A47C 4/40 297/27
2,603,273 A * 7/1952 Gambrill ..... A47C 1/035 297/28 X
2,638,970 A * 5/1953 Harber ..... A47C 4/48 297/27
2,872,969 A * 2/1959 Thomas ..... A47C 1/0265 297/28 X
2,887,150 A * 5/1959 Thomas ..... A47C 4/26 297/28 X
2,920,686 A * 1/1960 Thomas ..... A47C 1/143 297/28 X
2,964,097 A * 12/1960 Moore ..... A47C 1/143 297/28 X
2,964,099 A * 12/1960 Panicci ..... A47C 1/0265 297/28 X
2,972,373 A * 2/1961 Thomas ..... A47C 1/0265 297/28
3,099,478 A * 7/1963 Pearlstine ..... A47C 4/40 297/28 X
3,495,868 A * 2/1970 Venderminden ..... A47C 4/28 297/27
3,709,554 A * 1/1973 Feher ..... A47C 4/26 297/28 X
4,072,341 A * 2/1978 Kurz ..... A47C 1/035 297/27 X
4,482,184 A * 11/1984 Mincey ..... A47C 4/22 297/28 X
4,674,793 A * 6/1987 Kettler ..... A47C 1/0265 297/28 X
4,715,650 A * 12/1987 Berman ..... A47C 4/42 297/28 X
4,776,634 A * 10/1988 Pugliese ..... A47C 1/026 297/28 X
4,784,432 A * 11/1988 Brown ..... A47C 1/0265 297/28 X
4,792,181 A * 12/1988 Guichon ..... A47C 4/26 297/28 X
4,898,421 A * 2/1990 Brunn ..... A47C 1/026 297/28 X
5,464,270 A * 11/1995 Chang ..... A47C 4/24 297/28 X
5,570,926 A * 11/1996 Papiernik ..... A47C 4/26 297/27 X
5,825,095 A * 10/1998 Albecker, III ..... A47C 7/46 5/419
5,855,409 A * 1/1999 Tseng ..... A47C 4/14 297/27
6,030,032 A * 2/2000 Tseng ..... A47C 1/027 297/38
6,056,172 A * 5/2000 Welsh ..... A47C 4/52 297/28 X
6,450,569 B1 * 9/2002 Liu ..... A47C 4/20 297/39
6,502,899 B2 * 1/2003 Tseng ..... A47C 7/54 297/28 X
6,692,068 B1 * 2/2004 Tang ..... A47C 1/03244 297/27 X
6,902,231 B1 * 6/2005 Tseng ..... A47C 1/035 297/27
RE39,022 E * 3/2006 Welsh ..... A47C 4/52 297/28 X
7,500,715 B1 * 3/2009 Chen ..... A47C 4/46 297/27
7,950,734 B2 * 5/2011 Zheng ..... A47C 1/03244 297/27
10,194,749 B1 * 2/2019 Doolan ..... A47C 4/06
10,463,157 B1 * 11/2019 Liniado ..... A47C 4/52
10,561,249 B2 * 2/2020 Doolan ..... A47C 7/70
10,743,670 B2 * 8/2020 Winterhalter ..... A47G 23/0225
11,751,689 B2 * 9/2023 Pesek ..... A47C 4/04 297/16.1
2002/0121800 A1 * 9/2002 Yu ..... A47C 4/22 297/27
2002/0171269 A1 * 11/2002 Liu ..... A47C 4/10 297/35
2023/0087726 A1 * 3/2023 Mullet ..... A47C 4/00 297/19
2023/0404265 A1 * 12/2023 Preutz ..... A47C 4/28

* cited by examiner

SEATING APPARATUS

TECHNICAL FIELD

The present invention relates generally to a seating apparatus and more particularly relates to an adjustable seating apparatus configured to be operated in unfolded and folded conditions for accommodating a person in a seated position and for convenient storage transportation.

BACKGROUND

Generally, a seating apparatus such as a chair is designed for supporting and accommodating a person in a seated position. The seating apparatus includes a seat, a backrest, and one or more legs or other support structures. The seating apparatus is designed in numerous styles and designs based on their use in different areas (homes, offices, restaurants, and the like). While the conventional chairs (or the seating apparatus) are widely used and generally functional, they may present several problems or limitations, depending on factors such as design, materials, and usage context. For instance, the conventional seating apparatus often lacks adjustable features, making it challenging to customize the chair to individual preferences and ergonomic needs. Due to limited flexibility with bulky designs, the conventional seating apparatus occupies significant space, and limits flexibility in room layout and storage options.

Further, folding seating apparatuses have been popular from the time of their conception. Typical types of folding seating apparatuses include wood or metal frames, fabric slings, or plastic and wicker panels and are used for outdoor occasions, or when storage and portability are desired. They are generally less comfortable and less attractive than traditional indoor sofas or lounge chairs since indoor permanent furniture is generally built stronger, and heavier, with more padding and more comfort than temporary folding furniture. Additionally, the foldable seating apparatus has unappealing designs that detract from the overall aesthetic of interior or outdoor spaces.

Therefore, there is a need for a seating apparatus with adjustability features for comfortably accommodating a person in the seated position and allowing convenient storage and transportation without compromising the aesthetic appearance of the scating apparatus to overcome the aforementioned deficiencies along with providing other advantages.

SUMMARY

Various embodiments of the present disclosure disclose a seating apparatus.

In an embodiment, a seating apparatus is disclosed. The seating apparatus includes a seat member including a front portion and a rear portion, a backrest member including a top portion and a bottom portion, and an armrest frame. The armrest frame includes a left armrest member, a right armrest member, and at least one connecting member rigidly connecting the left armrest member to the right armrest member. The bottom portion of the backrest member is pivotally mounted to the rear portion of the seat member. and the top portion of the back rest member is pivotally mounted to the connecting member of the armrest frame. The seating apparatus includes a front support frame. The front support frame includes a left front support structure, a right front support structure, and at least one front connecting member connecting the left front support structure and the right front support structure. The left front support structure and the right front support structure are pivotally mounted to the left armrest member and the right armrest member, respectively. Further, the front support frame is pivotally connected to the seat member. The seating apparatus further includes a rear support frame. The rear support frame includes a left rear support structure, a right rear support structure, and at least one rear connecting member connecting the left rear front support structure and the right rear support structure. The left rear support structure and the right rear support structure are pivotally coupled to the left front support structure and the right front support structure, respectively. The pivotal coupling of the seat member, the backrest member, the armrest frame, the front support frame, and the rear support frame facilitates the seating apparatus to be operated in an unfolded condition and a folded condition. The seating apparatus is operated to the folded condition by lifting the backrest member in an upward direction away from the at least one rear connecting member causing the seat member to be lifted into a position in line with the backrest member. This causes a distal end of the armrest frame to pivot in the upward direction and allowing the front support frame and the rear support frame to pivot in a direction to align with the seat member and the backrest member in the folded condition. Further, the armrest frame, the rear support frame, and the front support frame are positioned on top of each other, and aligned with the seat member and the backrest member in the folded condition. Furthermore, the seating apparatus is operated to the unfolded condition by pushing the backrest member in a downward direction towards the seat member until the seat member is inclined relative to the backrest member to form a first orientation. This causes the distal end of the armrest frame to pivot in a direction parallel to the seat member and the front support frame and the rear support frame to pivot into a second orientation with the front portion of the seat member supported by the front support frame and the rear portion of the seat member supported by the at least one rear connecting member. The left armrest member and the right armrest member operate synchronously to prevent deformation of the seating apparatus while the seating apparatus is operating between the folded position and the unfolded position.

BRIEF DESCRIPTION OF THE FIGURES

The following detailed description of illustrative embodiments is better understood when read in conjunction with the appended drawings. For the purposes of illustrating the present disclosure, exemplary constructions of the disclosure are shown in the drawings. However, the present disclosure is not limited to a specific device, or a tool and instrumentalities disclosed herein. Moreover, those in the art will understand that the drawings are not to scale. Wherever possible, like elements have been indicated by identical numbers.

The drawings referred to in this description are not to be understood as being drawn to scale except if specifically noted, and such drawings are only exemplary in nature.

DETAILED DESCRIPTION

In the following description, for purposes of explanation, numerous specific details are set forth in order to provide a thorough understanding of the present disclosure. It will be apparent, however, to one skilled in the art that the present disclosure can be practiced without these specific details. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

Reference in this specification to "one embodiment" or "an embodiment" means that a particular feature, structure, or characteristic described in connection with the embodiment is included in at least one embodiment of the present disclosure. The appearances of the phrase "in an embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not for other embodiments.

Moreover, although the following description contains many specifics for the purposes of illustration, anyone skilled in the art will appreciate that many variations and/or alterations to said details are within the scope of the present disclosure. Similarly, although many of the features of the present disclosure are described in terms of each other, or conjunction with each other, one skilled in the art will appreciate that many of these features can be provided independently of other features.

Various embodiments of the present invention are described hereinafter with reference to FIGS. 1A and 1B to FIG. 10.

Figure 1A:
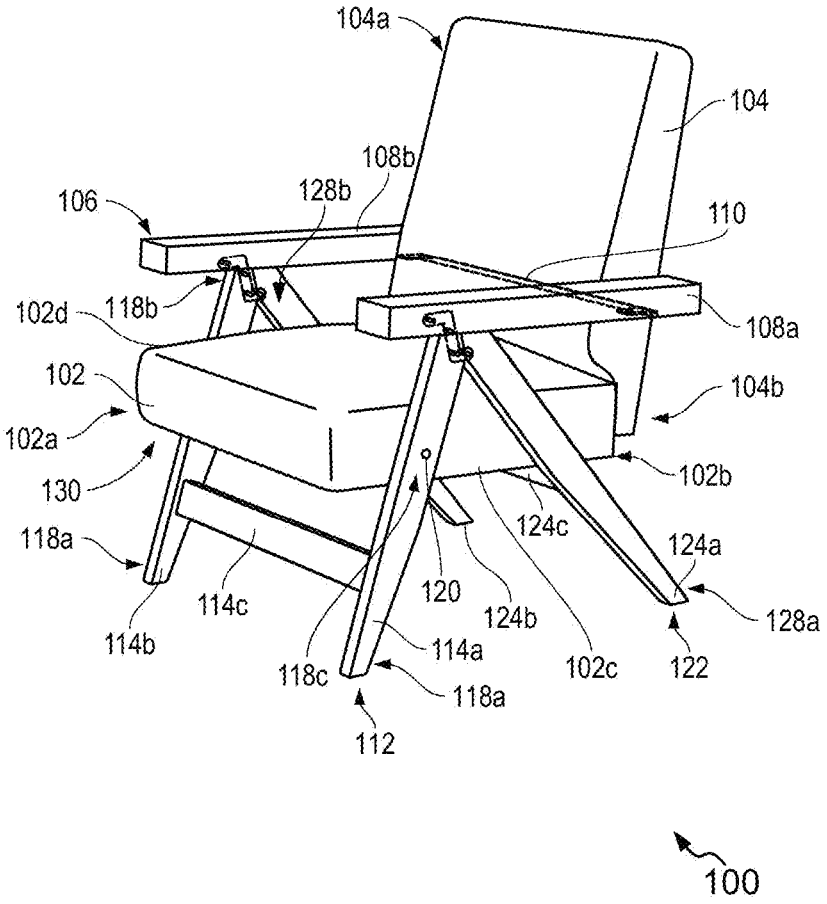
FIG. 1A illustrates a perspective view of a seating apparatus operated in an unfolded condition, in accordance with an embodiment of the present disclosure.
Figure 1B:
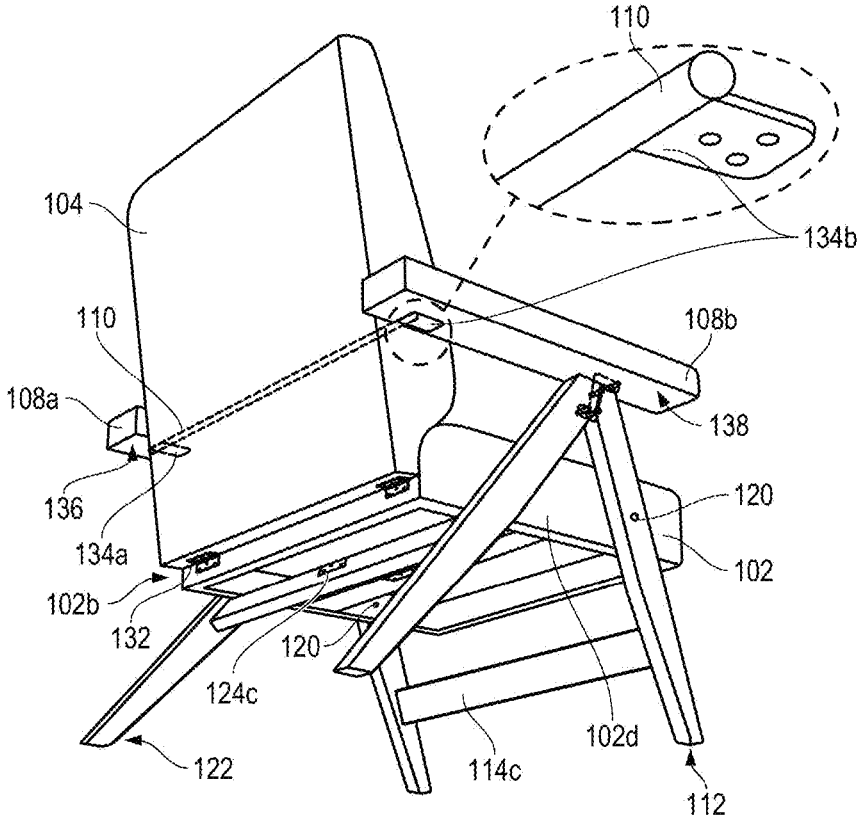
FIG. 1B illustrates a rear perspective view of the seating apparatus of FIG. 1A, in accordance with an embodiment of the present disclosure.

FIGS. 1A and 1B illustrate a schematic representation of a seating apparatus 100, in accordance with an embodiment of the present disclosure. The seating apparatus 100 includes a seat member 102, a backrest member 104, and an armrest frame 106. The seat member 102 and the backrest member 104 may be upholstered. The seat member 102 and the backrest member 104 may be interchangeably referred to as the upholstered seat member 102 and the upholstered backrest member 104, respectively. The upholstered seat member 102 and the upholstered backrest member 104 typically include padding or cushioning covered with fabric or leather upholstery for added comfort and aesthetic appeal.

The backrest member 104 is pivotally mounted to the seat member 102 via a mounting means (see, 132 of FIG. 1B). For example, the mounting means 132 may include hinges (as shown in FIG. 1B). In particular, the backrest member 104 includes a top portion 104*a* and a bottom portion 104*b*. The seat member 102 includes a front portion 102*a* and a rear portion 102*b*. The rear portion 102*b* of the seat member 102 is pivotally hinged to the bottom portion 104*b* of the backrest member 104. In an embodiment, the seat member 102 and the backrest member 104 may be pivotally coupled to each other using articulating arms, spring hinges, linkage systems, swivel joints, and the like.

The armrest frame 106 includes a left armrest member 108*a*, a right armrest member 108*b*, and at least one connecting member 110 connecting the left armrest member 108*a* and the right armrest member 108*b*. Further, the armrest frame 106 forms a U-shaped configuration. In an embodiment, the armrest frame 106 may be made of wood, or any other materials as per design requirement. In another embodiment, the left armrest member 108*a* and the right armrest member 108*b* may be upholstered. The connecting member 110 may be dimensioned in conformity to a width dimension of the backrest member 104. The connecting member 110 is pivotally mounted to the backrest member 104 using conventional mounting means. Specifically, the top portion 104*a* of the backrest member 104 is pivotally connected to the connecting member 110 of the armrest frame 106. The connecting member 110 is disposed within the upholstered backrest member 104. In other words, the backrest member 104 conceals the connecting member 110 coupling the left armrest member 108*a* and the right armrest member 108*b*. This results in enhancing the aesthetic appeal of the seating apparatus 100.

Further, the connecting member 110 may include a first mounting provision (see, 134*a* FIG. 1B) and a second mounting provision (see, 134*b* of FIG. 1B). For example, the first mounting provision 134*a* and the second mounting provision 134*b* are flange members. In one embodiment, the first mounting provision 134*a* and the second mounting provision 134*b* may be welded at the extreme ends of the connecting member 110, thus forming a unitary structure of the connecting member 110. In another embodiment, the first mounting provision 134*a* and the second mounting provision 134*b* may be detachably mounted to the extreme ends of the connecting member 110 using conventional mounting means. As shown, the first mounting provision 134*a* is coupled to a bottom portion (see, 136 of FIG. 1B) of the left armrest member 108*a*, and the second mounting provision 134*b* is coupled to a bottom portion (see, 138 of FIG. 1B) of the right armrest member 108*b*. Further, the first mounting provision 134*a* and the second mounting provision 134*b* of the connecting member 110 coupled to the left armrest member 108*a* and the right armrest member 108*b*, respectively, form a U-shape configuration of the armrest frame 106. Furthermore, the connecting member 110 coupling the left armrest member 108*a* and the right armrest member 108*b* prevents deformation of the seating apparatus 100 due to the coordinated synchronic pivotal movements of the left armrest member 108*a* and the right armrest member 108*b* while the seating apparatus 100 is operating between a folded condition (see, 402 of FIG. 4) and an unfolded condition (see, 130 of FIG. 1A). In other words, the connecting member 110 forces the right armrest member 108*b* and the left armrest member 108*a* to pivot simultaneously during folding and unfolding of the seating apparatus 100.

The seating apparatus 100 further includes a front support frame 112. The front support frame 112 may be made of wood, metal, or any other materials as per design requirements. The front support frame 112 includes a left front support structure 114*a*, a right front support structure 114*b*, and at least one front connecting member 114*c*. The front connecting member 114*c* connects the left front support structure 114*a* and the right front support structure 114*b*. In particular, the front connecting member 114*c* is mounted proximate to a bottom portion 118*a* of each of the left front support structure 114*a* and the right front support structure 114*b*. The front connecting member 114*c* ensures the stability of the left front support structure 114*a* and the right front support structure 114*b* while the seating apparatus 100 is operated between the folded condition 402 and the unfolded condition 130. Further, the left front support structure 114*a* and the right front support structure 114*b* are pivotally mounted to the left armrest member 108*a* and the right armrest member 108*b*, respectively. Specifically, a top portion 118*b* of each of the left front support structure 114*a* and the right front support structure 114*b* are pivotally mounted to the left armrest member 108*a* and the right armrest member 108*b*, respectively. Further, each of the left front support structure 114*a* and the right front support structure 114*b* includes an intermediate portion 118*c* adapted to be pivotally coupled to a pivot point 120 defined in a left side surface 102*c* and a right side surface 102*d* proximate to the front portion 102*a* of the seat member 102, respectively.

Further, the seating apparatus 100 includes a rear support frame 122. The rear support frame 122 may be made of wood, metal, or any other materials as per design requirements. The rear support frame 122 includes a left rear support structure 124*a*, a right rear support structure 124*b*, and at least one rear connecting member 124*c*. The rear connecting member 124*c* connects the left rear support structure 124*a* and the right rear support structure 124*b*. In particular, the rear connecting member 124*c* is mounted proximate to a bottom portion 128*a* of each of the left rear support structure 124*a* and the right rear support structure 124*b*. The rear connecting member 124*c* supports the rear portion 102*b* of the seat member 102 while the seating apparatus 100 is operated in the unfolded condition 130. Further, the left rear support structure 124*a* and the right rear support structure 124*b* are pivotally coupled to the left front support structure 114*a* and the right front support structure 114*b*, respectively. Specifically, a top portion 128*b* of each of the left rear support structure 124*a* and the right rear support structure 124*b* are pivotally mounted to the top portion 118*b* of each of the left front support structure 114*a* and the right front support structure 114*b*, respectively.

Figure 2A:
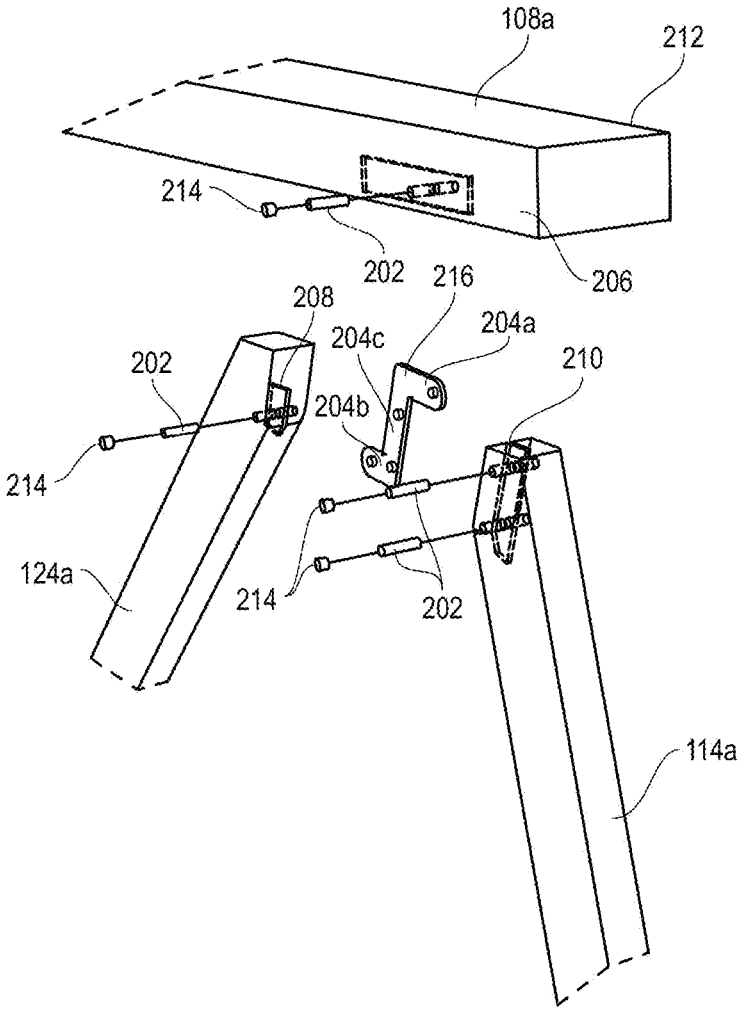
FIG. 2A illustrates an exploded view of a left portion of the seating apparatus of FIG. 1A depicting the pivotal coupling of a left armrest member, a left front support structure, and a left rear support structure using a first mounting member, in accordance with an embodiment of the present disclosure.

Referring to FIG. 2A in conjunction with FIGS. 1A and 1B, the left front support structure 114*a*, the left rear support structure 124*a*, and the armrest frame 106 (i.e., the left armrest member 108*a*) may be pivotally coupled using a first mounting member 216. As shown, the first mounting member 216 is coupled to the left front support structure 114*a*, the left rear support structure 124*a*, and the left armrest member 108*a* via a first set of fastening members 202.

The first mounting member 216 includes a first portion 204*a*, a second portion 204*b*, and a third portion 204*c*. The first portion 204*a* is accommodated in a recessed slot 206 configured in the bottom portion 136 proximate to a proximal end 212 of the left armrest member 108*a*. The first portion 204*a* is pivotally coupled to the left armrest member 108*a* via the first set of fastening members 202. Further, the second portion 204*b* is accommodated in a recessed slot 208 configured in the top portion 128*b* of the left rear support structure 124*a*. The second portion 204*b* of the first mounting member 216 is pivotally coupled to the left rear support structure 124*a* via the first set of fastening members 202. Furthermore, the third portion 204*c* of the first mounting member 216 connects the first portion 204*a* and the second portion 204*b*. The third portion 204*c* is adapted to be accommodated in a recessed slot 210 defined in the top portion 118*b* of the left front support structure 114*a*. The third portion 204*c* is mounted (fixedly) to the left front support structure 114*a* via the first set of fastening members 202.

It is to be noted that the recessed slots 206, 208, and 210 are configured in conformity with the dimensions of the first mounting member 216 for allowing a snug fit of the first mounting member 216. Further, the recessed slots 206, 208, and 210 may be configured with holes corresponding to holes defined in the first mounting member 216 for allowing the coupling of the first mounting member 216 with the left front support structure 114*a*, the left rear support structure 124*a*, and the left armrest member 108*a* using the first set of fastening members 202. In particular, the first set of fastening members 202 (i.e., two fastening members) are used to fixedly connect the third portion 204*c* of the first mounting member 216 to the left front support structure 114*a*. This prevents the first mounting member 216 from rotating in the top portion 118*b* of the left front support structure 114*a*. The first set of fastening members 202 (i.e., a single fastening member) is used to couple the second portion 204*b* to the left rear support structure 124*a*. This enables the pivotal connection of the left rear support structure 124*a* to the left front support structure 114*a* and allows rotation of the left rear support structure 124*a* relative to the left front support structure 114*a*. Further, the first set of fastening members 202 (i.e., a single fastening member) is used to couple the first portion 204*a* to the left armrest member 108*a*. This enables the pivotal connection of the left front support structure 114*a* to the left armrest member 108*a* and allows rotation of the left armrest member 108*a* relative to the left front support structure 114*a*.

Further, the first set of fastening members 202 are recessed into the left armrest member 108*a*, the left front support structure 114*a*, and the left rear support structure 124*a* and capped with a first set of plug members 214. In particular, when the seating apparatus 100 is in the unfolded condition 130, the first mounting member 216 is completely hidden from view, while the first set off astening members 202 and the first set of plug members 214 hide any connection points to the left armrest member 108*a*, the left front support structure 114*a* and the left rear support structure 124*a*. Thus, the seating apparatus 100 displays no outward signs of any folding mechanisms when unfolded which further enhances the aesthetic appearance of the seating apparatus 100.

Similarly, the first mounting member 216 may be coupled to the right front support structure 114*b*, the right rear support structure 124*b*, and the right armrest member 108*b* via the first set of fastening members 202. Further, the functionality of the first mounting member 216 pivotally coupled to the right front support structure 114*b*, the right rear support structure 124*b*, and the right armrest member 108*b* is similar to the first mounting member 216 coupled to the left front support structure 114*a*, the left rear support structure 124*a*, and the left armrest member 108*a*. For the sake of brevity, the description related to the first mounting member 216 pivotally coupled to the right front support structure 114*b*, the right rear support structure 124*b*, and the right armrest member 108*b* via the first set of fastening members 202, and the functionality is not described herein.

Figure 2B:
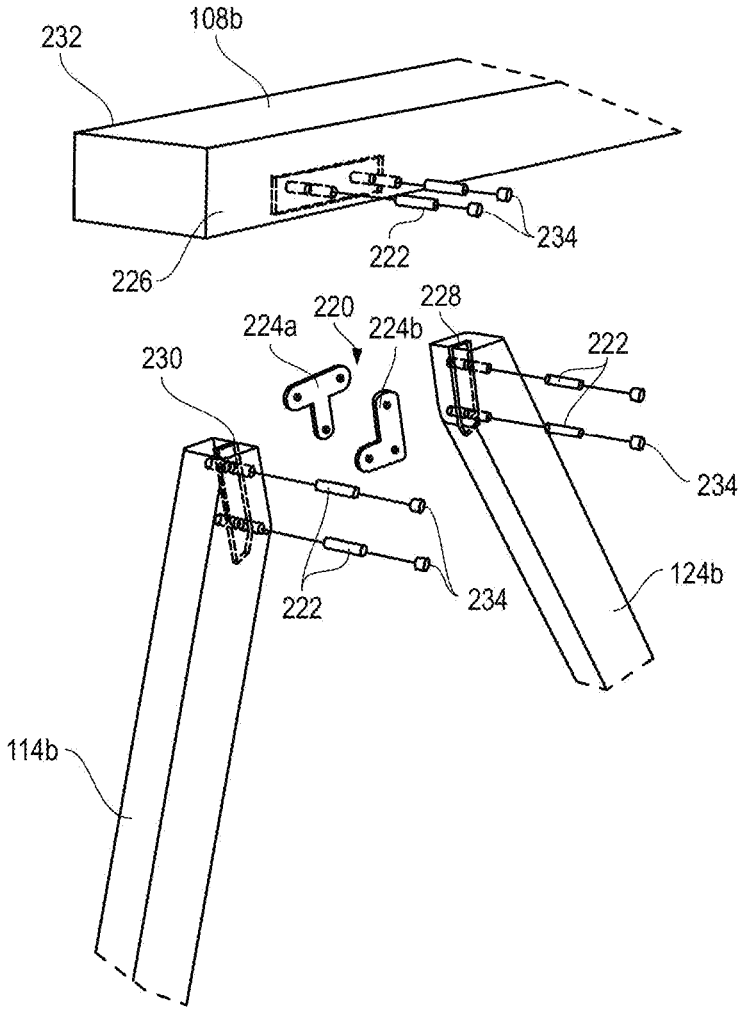
FIG. 2B illustrates an exploded view of a right portion of the seating apparatus of FIG. 1A depicting an alternate pivotal coupling of a right armrest member, a right front support structure, and a right rear support structure using a second mounting member, in accordance with an embodiment of the present disclosure.

Referring to FIG. 2B in conjunction with FIGS. 1A and 1B, the right front support structure 114*b*, the right rear support structure 124*b*, and the right armrest member 108*b* may be pivotally coupled using a second mounting member 220. The seating apparatus 100 may include the first mounting member 216, the second mounting member 220, or the combination thereof based on the design feasibility and requirement. As shown, the second mounting member 220 is a modular structure. The second mounting member 220 includes at least one first mounting plate 224*a* and at least one second mounting plate 224*b*. In an embodiment, the at least one first mounting plate 224*a* and the at least one second mounting plate 224*b* may be integrally coupled to each other.

The at least one first mounting plate 224*a* is configured to pivotally couple the top portion 118*b* of the front support frame 112 to the bottom portion 138 of the armrest frame 106. In particular, the at least one first mounting plate 224*a* is coupled via a second set of fastening members 222 to a recessed slot 226 configured in the bottom portion 138 of the right armrest member 108*b*, and a recessed slot 230 configured in the top portion 118*b* of the right front support structure 114*b*. This enables the pivotal connection of the right front support structure 114*b* to the right armrest member 108*b* and allows rotation of the right armrest member 108*b* relative to the right front support structure 114*b*.

Further, the at least one second mounting plate 224*b* is configured to pivotally couple the top portion 128*b* of the rear support frame 122 to the top portion 118*b* of the front support frame 112. In particular, the at least one second mounting plate 224*b* is coupled via the second set of fastening members 222 to the recessed slot 230 configured in the top portion 118*b* of the right front support structure 114*b*, and a recessed slot 228 configured in the top portion 128*b* of the right rear support structure 124*b*. This enables the pivotal connection of the right rear support structure 124*b* to the right front support structure 114*b* and allows rotation of the right rear support structure 124*b* relative to the right front support structure 114*b*.

Further, the second set of fastening members 222 are recessed into the right armrest member 108*b*, the right front support structure 114*b*, and the right rear support structure 124*b* and capped with a second set of plug members 234. In particular, when the seating apparatus 100 is in the unfolded condition 130, the second mounting member 220 (or the first mounting plate 224*a* and the second mounting plate 224*b*) is completely hidden from view, while the second set of fastening members 222 and the second set of plug members 234 hide any connection points to the right armrest member 108*b*, the right front support structure 114*b* and the right rear support structure 124*b*. Thus, the seating apparatus 100 displays no outward signs of any folding mechanisms when unfolded which further enhances the aesthetic appearance of the seating apparatus 100.

Similarly, the second mounting member 220 (or the first mounting plate 224*a* and the second mounting plate 224*b*) may be coupled to the left front support structure 114*a*, the left rear support structure 124*a*, and the left armrest member 108*a* via the second set of fastening members 222. Further, the functionality of the second mounting member 220 (or the first mounting plate 224*a* and the second mounting plate 224*b*) pivotally coupled to the left front support structure 114*a*, the left rear support structure 124*a*, and the left armrest member 108*a* is similar to the second mounting member 220 coupled to the right front support structure 114*b*, the right rear support structure 124*b*, and the right armrest member 108*b*. For the sake of brevity, the description related to the second mounting member 220 pivotally coupled to the left front support structure 114*a*, the left rear support structure 124*a*, and the left armrest member 108*a* via the second set of fastening members 222, and the functionality is not described herein.

Figure 3:
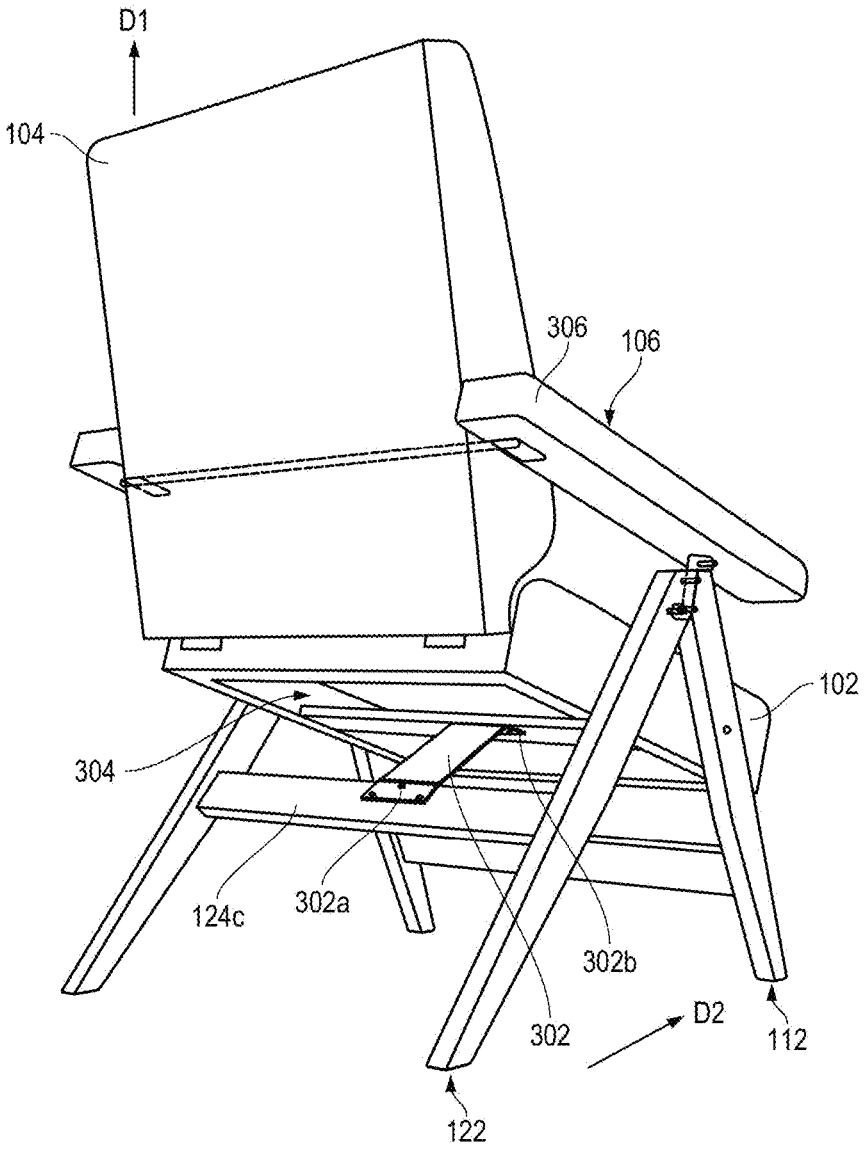
FIG. 3 is a schematic representation of the seating apparatus of FIG. 1A depicting articulation of the seating apparatus, in accordance with an embodiment of the present disclosure.

FIG. 3 is a schematic representation of the seating apparatus 100 depicting articulation of the seating apparatus 100, in accordance with an embodiment of the present disclosure. The pivotal coupling of the seat member 102, the backrest member 104, the armrest frame 106, the front support frame 112, and the rear support frame 122 facilitate the seating apparatus 100 to be operated in the unfolded condition 130 and the folded condition 402.

In particular, for folding the seating apparatus 100, the backrest member 104 is lifted in an upward direction (see, 'D1') away from the rear connecting member 124*c* (as shown in FIG. 3) causing the seat member 102 and the backrest member 104 to pivot relative to each other from, a substantially perpendicular L-shaped configuration to a linear configuration lying parallel and adjacent to each other. As a result, a distal end 306 of the armrest frame 106 moves in the upward direction D1 and allows the front support frame 112 and the rear support frame 122 to pivot in a forward direction 'D2'. In other words, the distal end 306 of the armrest frame 106 pivots in the upward direction D1 and allows the front support frame 112 and the rear support frame 122 to pivot in a direction to align with the seat member 102 and the backrest member 104 in the folded condition 402. This causes all the pivotally interconnected components of the seating apparatus 100 such as the backrest member 104, the seat member 102, the armrest frame 106, the front support frame 112, and the rear support frame 122 to move into a flat compact configuration (i.e., the folded condition 402). Specifically, the armrest frame 106, the rear support frame 122, and the front support frame 112 are positioned on top of each other, and aligned with the seat member 102 and the backrest member 104 in the folded condition 402.

Additionally, the seat apparatus 100 includes a connecting bracket 302. The connecting bracket 302 includes a first end 302*a* mounted to the rear connecting member 124*c* and a second end 302*b* mounted to a bottom portion 304 of the seat member 102. In other words, the first end 302*a* is hingedly connected to the rear connecting member 124*c*, and the second 302*b* is hingedly connected to the bottom portion 304 of the seat member 102. The connecting bracket 302 facilitates the pivotal movement of the rear support frame 122 for positioning the rear support frame 122 parallel to the seat member 102 and adjacent to the front support frame 112 while the seating apparatus 100 is operated in the folded condition 402. In other words, the connecting bracket 302 serves to automatically direct the rear support frame 122 to lie parallel and adjacent to the front support frame 112 when the seat member 102 is lifted during the folding process. In addition, the connecting bracket 302 serves to automatically direct the rear support frame 122 to form an A-shaped configuration along with the front support frame 112 during the unfolding process.

Figure 4:
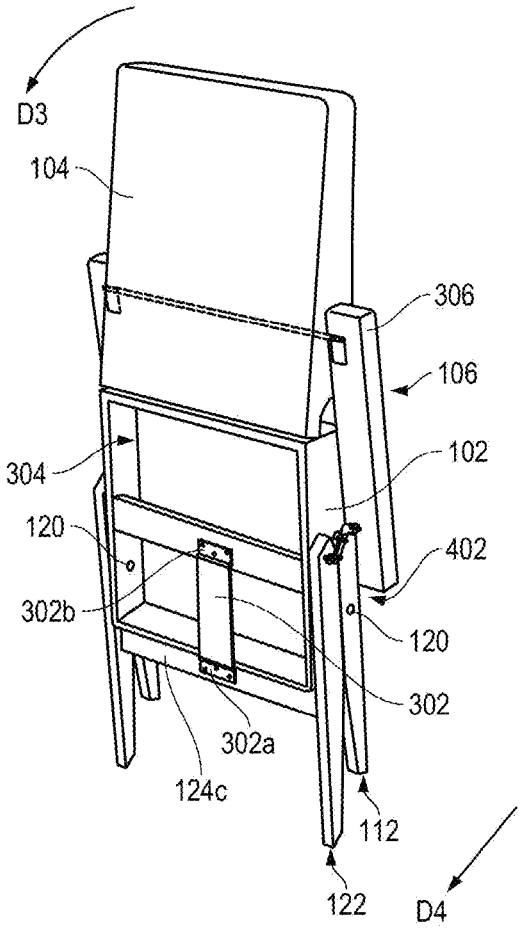
FIG. 4 illustrates a schematic representation of the seating apparatus of FIG. 1A operated in a folded condition, in accordance with an embodiment of the present disclosure.

FIG. 4 illustrates a schematic representation of the seating apparatus 100 operated in the folded condition 402, in accordance with an embodiment of the present disclosure. As explained above, the pivot point 120 defined in the seat member 102 is located at a specific point in the side of the seat member 102 to ensure that while folding, the front support frame 112 rotates parallel to the seat member 102 and the rear support frame 122 pivots to lie adjacent to the front support frame 112. As a result, both the front support frame 112 and the rear support frame 122 lie within the dimensions defined by a top surface and a bottom surface of the seat member 102 when the seating apparatus 100 is operated in the folded condition 402. In other words, stacking the front support frame 112 and the rear support frame 122 does not add additional thickness to the overall height of the seating apparatus 100 when folded. This ensures that the folded seating apparatus fits into a compact efficient space for shipping or storage.

For unfolding the seating apparatus 100, the backrest member 104 may be pushed in a downward direction (see, 'D3' of FIG. 4) until the rear portion 102*b* of the seat member is supported on the rear connecting member 124*c* to form a first orientation (as shown in FIG. 1B). The first orientation between the seat member 102 and the backrest member 104 corresponds to a substantially L-shaped configuration (as shown in FIG. 1B). In other words, the backrest member 104 may be pushed in the downward direction D3 until the rear portion 102*b* of the seat member is supported on the rear connecting member 124*c* causing the seat member 102 and backrest member 104 to pivot relative to each other from a linear configuration (i.e., the folded condition 402) lying parallel and adjacent to each other to a substantially perpendicular L-shaped configuration. As a result, the distal end 306 of the armrest frame 106 moves in the downward direction D3 and allows the front support frame 112 and the rear support frame 122 to pivot in a rearward direction (see, 'D4' of FIG. 4) for operating the seating apparatus 100 in the unfolded condition 130 (as shown in FIG. 1A). In other words, the distal end 306 of the armrest frame 106 pivots in a direction parallel to the seat member 102 and causing the front support frame 112 and the rear support frame 122 to pivot into a second orientation with the front portion 102*a* of the seat member 102 supported by the front support frame 112 and the rear portion 102*b* of the seat member 102 supported by the at least one rear connecting member 124*c*.

Additionally, the connecting bracket 302 allows the rear portion 102*b* of the seat member 102 to be supported on the rear connecting member 124*c* while the seating apparatus 100 is operated in the unfolded condition 130. In other words, during the unfolding process, the connecting bracket 302 serves to automatically position the rear support frame 122 for supporting the seat member 102. Further, in the unfolded condition 130, the left rear support structure 124*a* is oriented angularly relative to the left front support structure 114*a*, and the right front support structure 114*b* is oriented angularly relative to the right rear support structure 124*b* (as shown in FIG. 1A). In other words, the left front support structure 114*a* and the left rear support structure 124*a*, and the right front support structure 114*b* and the right rear support structure 124*b* form a second orientation between the front support frame and the rear support frame which is a substantially A-shaped configuration (as shown in FIG. 1A). This allows the seat member 102 to be supported by the front support frame and rear support frame in a horizontal position with the armrest frame 106 parallel to the seat member 102 (as shown in FIG. 1A) and the backrest member 104 in a relatively vertical position between the armrest frame 106 and the seat member 102.

Figures 5A, 5B:
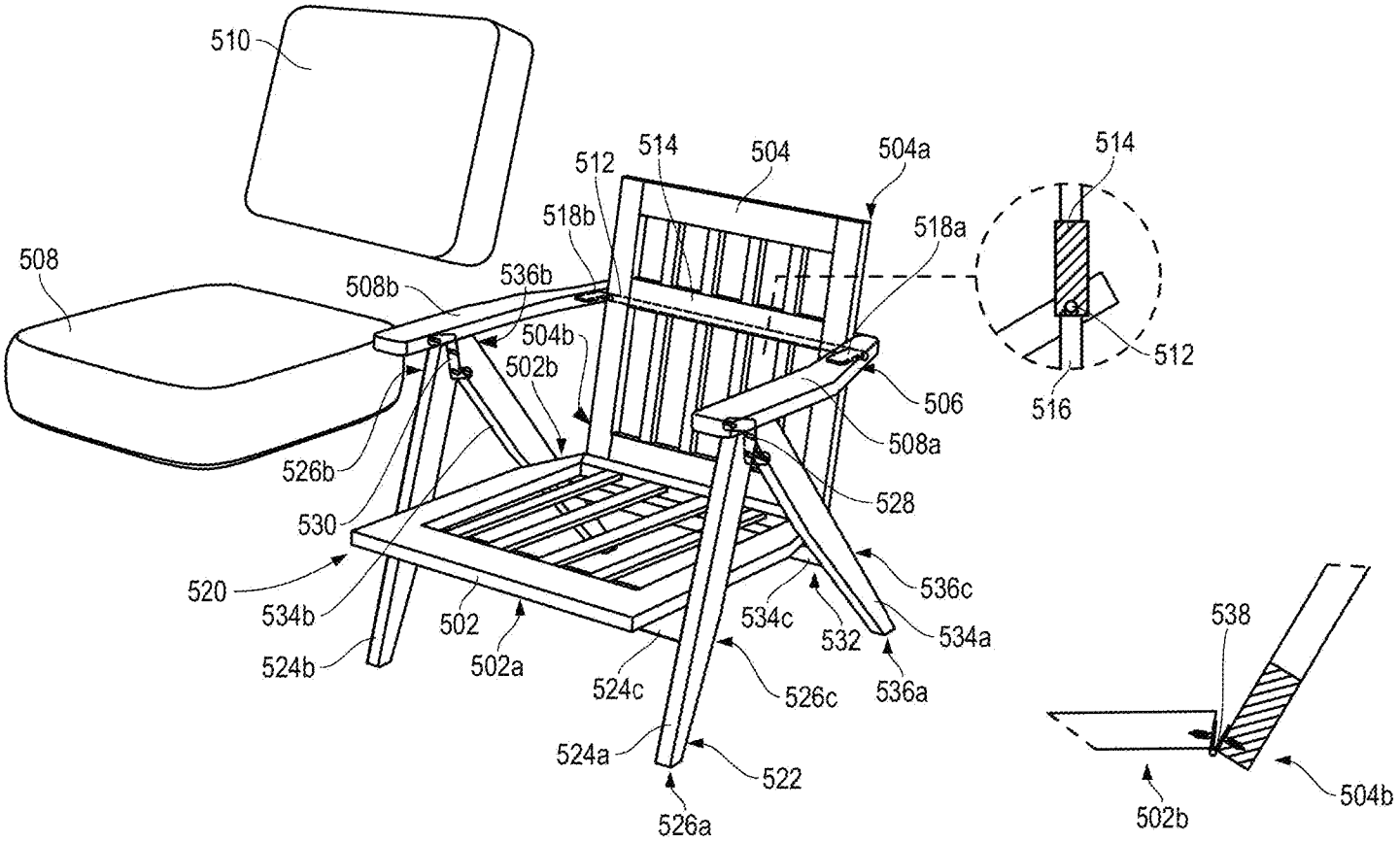
FIG. 5A illustrates a perspective view of a seating apparatus, in accordance with an embodiment of the present disclosure.
FIG. 5B illustrates a sectional view of the seating apparatus of FIG. 5A depicting the pivotal coupling of a seat member and a backrest member of the seating apparatus of FIG. 5A, in accordance with an embodiment of the present disclosure.

FIG. 5A illustrates a perspective view of a seating apparatus 500, in accordance with an embodiment of the present disclosure. The seating apparatus 500 includes a seat member 502, a backrest member 504, and an armrest frame 506. The seat member 502 and the backrest member 504 may be made of wooden materials. Alternatively, the seat member 502 and the backrest member 504 may be made using metal, or any other materials as per the design feasibility and requirements. Further, the seating apparatus 500 includes a padded seat 508 and a padded backrest 510. The padded seat 508 is removably positioned on the seat member 502. The padded backrest 510 is removably positioned on the backrest member 504. The padded seat 508 and the padded backrest 510 provide comfort to a user seated in the seating apparatus 500.

As shown, the backrest member 504 is pivotally mounted to the seat member 502 via a mounting means (see, 538 of FIG. 5B). For example, the mounting means 538 may include hinges. In particular, the backrest member 504 includes a top portion 504*a* and a bottom portion 504*b*. The seat member 502 includes a front portion 502*a* and a rear portion 502*b*. The rear portion 502*b* of the seat member 502 is pivotally hinged to the bottom portion 504*b* of the backrest member 504. In an embodiment, the seat member 502 and the backrest member 504 may be pivotally coupled to each other using articulating arms, spring hinges, linkage systems, swivel joints, and the like.

The armrest frame 506 includes a left armrest member 508*a*, a right armrest member 508*b*, and at least one connecting member 512 connecting the left armrest member 508*a* and the right armrest member 508*b*. Further, the armrest frame 506 forms a U-shaped configuration. The armrest frame 506 may be made of wood, or any other materials as per design requirement. The connecting member 512 may be dimensioned in conformity to a width dimension of the backrest member 504. The connecting member 512 is pivotally mounted to the backrest member 504 using conventional mounting means. In particular, the backrest member 504 includes a crossbar 514 configured with a groove 516 for supporting the connecting member 512 of the armrest frame 506. In other words, the backrest member 504 includes the crossbar 514 defined with the groove 516 for receiving the connecting member 512 of the armrest frame 506. In this scenario, the connecting member 512 is hidden within the groove 516 of the crossbar 514 located within the frame of the backrest member 504. This results in enhancing the aesthetic appeal of the seating apparatus 100.

Further, the connecting member 512 may include a first mounting provision (see, 518*a*) and a second mounting provision (see, 518*b*). For example, the first mounting provision 518*a* and the second mounting provision 518*b* are flange members. In one embodiment, the first mounting provision 518*a* and the second mounting provision 518*b* may be welded at the extreme ends of the connecting member 512, thus forming a unitary structure of the connecting member 512. In another embodiment, the first mounting provision 518*a* and the second mounting provision 518*b* may be detachably mounted to the extreme ends of the connecting member 512 using conventional mounting means. As shown, the first mounting provision 518*a* is coupled to a bottom portion (see, 602 of FIG. 6) to the left armrest member 508*a*, and the second mounting provision 518*b* is coupled to a bottom portion (see, 604 of FIG. 6) of the right armrest member 508*b*. Further, the first mounting provision 518*a* and the second mounting provision 518*b* of the connecting member 512 coupled to the left armrest member 508*a* and the right armrest member 508*b*, respectively, form a U-shape configuration of the armrest frame 506. Furthermore, the connecting member 512 coupling the left armrest member 508*a* and the right armrest member 508*b* prevents deformation of the seating apparatus 500 due to the coordinated synchronic pivotal movement of the left armrest member 508*a* and the right armrest member 508*b* while the seating apparatus 500 is operating between a folded condition (see, 702 of FIG. 7) and an unfolded condition (see, 520). In other words, the connecting member 512 forces the right armrest 508*b* and left armrest 508*a* to pivot simultaneously during folding and unfolding.

The seating apparatus 500 further includes a front support frame 522. The front support frame 522 may be made of wood, or any other materials as per design requirement. The front support frame 522 includes a left front support structure 524*a*, a right front support structure 524*b*, and at least one front connecting member 524*c*. The front connecting member 524*c* connects the left front support structure 524*a* and the right front support structure 524*b*. In particular, the front connecting member 524*c* is mounted proximate to an intermediate portion 526*c* of each of the left front support structure 524*a* and the right front support structure 524*b*. In an embodiment, the front connecting member 524*c* is mounted proximate to a bottom portion 526*a* of each of the left front support structure 524*a* and the right front support structure 524*b*. Further, the front connecting member 524*c* is hingedly coupled to the front portion 502*a* of the seat member 502. This ensures the stability of the left front support structure 524*a* and the right front support structure 524*b* while the seating apparatus 500 is operated between the folded condition 702 and the unfolded condition 520. Further, the left front support structure 524*a* and the right front support structure 524*b* are pivotally mounted to the left armrest member 508*a* and the right armrest member 508*b*, respectively. Specifically, a top portion 526*b* of each of the left front support structure 524*a* and the right front support structure 524*b* are pivotally mounted to the left armrest member 508*a* and the right armrest member 508*b*, respectively.

Further, the seating apparatus 500 includes a rear support frame 532. The rear support frame 532 may be made of wood, or any other materials as per design requirement. The rear support frame 532 includes a left rear support structure 534*a*, a right rear support structure 534*b*, and at least one rear connecting member 534*c*. The rear connecting member 534*c* connects the left rear support structure 534*a* and the right rear support structure 534*b*. In particular, the rear connecting member 534*c* is mounted proximate to an intermediate portion 536*c* of each of the left rear support structure 534*a* and the right rear support structure 534*b*. In one embodiment, the rear connecting member 534*c* is mounted proximate to a bottom portion 536*a* of each of the left rear support structure 534*a* and the right rear support structure 534*b*. The rear connecting member 534*c* supports the rear portion 502*b* of the seat member 502 while the seating apparatus 500 is operated in the unfolded condition 520. Further, the left rear support structure 534*a* and the right rear support structure 534*b* are pivotally coupled to the left front support structure 524*a* and the right front support structure 524*b*, respectively. Specifically, a top portion 536*b* of each of the left rear support structure 534*a* and the right rear support structure 534*b* are pivotally mounted to the top portion 526*b* of each of the left front support structure 524*a* and the right front support structure 524*b*, respectively.

The seating apparatus 500 further includes a mounting member 528 and a mounting member 530. The mounting member 528 and the mounting member 530 are similar to the first mounting member 216. The mounting member 528 pivotally couples the left front support structure 524*a*, the left rear support structure 534*a*, and the left armrest member 508*a* via the fastening members. The mounting member 530 pivotally couples the right front support structure 524*b*, the right rear support structure 534*b*, and the right armrest member 508*b* via the fastening members. The pivotal coupling of the mounting members 528 and 530 are already explained with reference to FIG. 2A, therefore it is not reiterated herein for the sake of brevity. Alternatively, the second mounting member 220 may be used in the seating apparatus 500 for pivotally coupling the left front support structure 524*a*, the left rear support structure 534*a*, and the left armrest member 508*a*, and pivotally coupling the right front support structure 524*b*, the right rear support structure 534*b*, and the right armrest member 508*b*.

Figure 6:
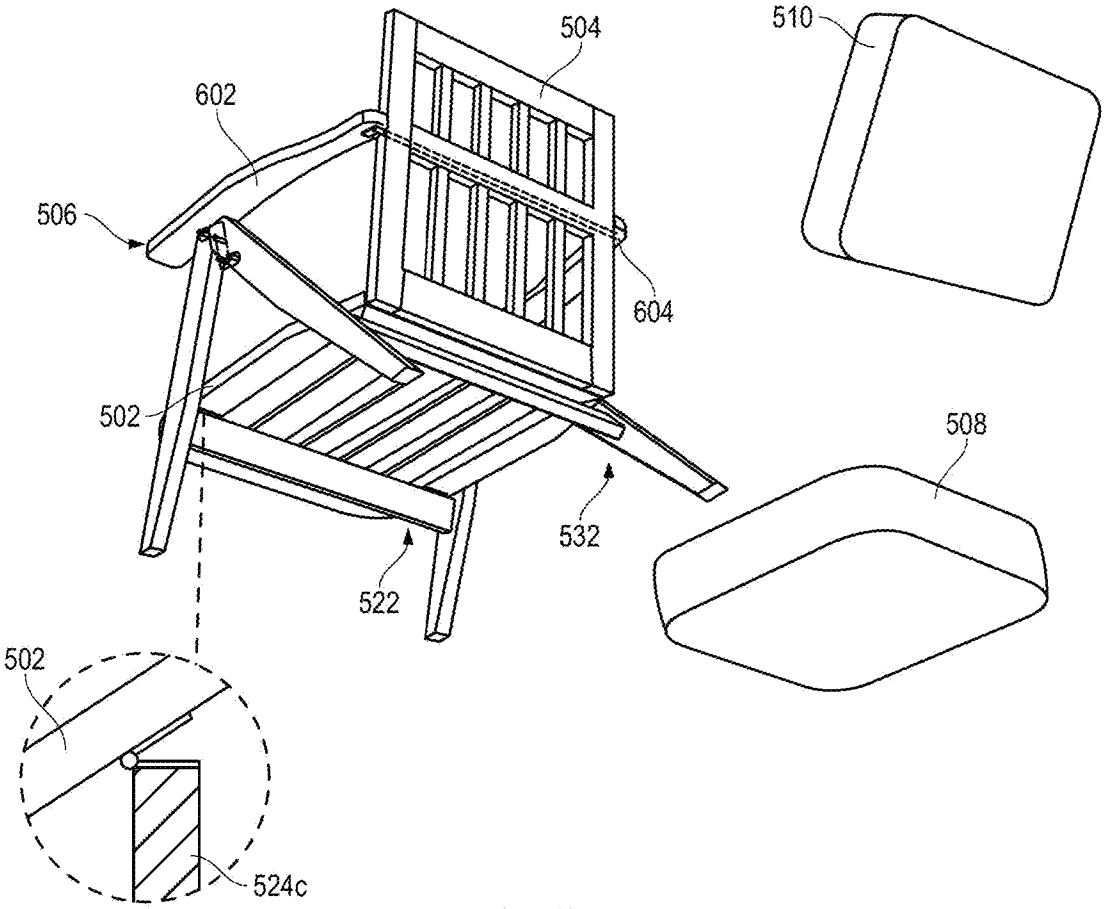
FIG. 6 is a rear bottom perspective view of the seating apparatus of FIG. 5A, in accordance with an embodiment of the present disclosure.

Referring to FIG. 6 in conjunction with FIG. 5A, the seating apparatus 500 is configured to be operated between the unfolded condition 520 and the folded condition 702 due to the pivotal movement of the seat member 502, the backrest member 504, the armrest frame 506, the front support frame 522, and the rear support frame 532. In the unfolded condition 520, the front portion 502*a* of the seat member 502 is supported on the front connecting member 524*c*, and the rear portion 502*b* of the seat member 502 is supported on the rear connecting member 534*c* (as shown in FIG. 5A). For operating the seating apparatus 500 in the folded condition 702, the padded seat 508 and the padded backrest 510 are removed from the seat member 502 and the backrest member 504, respectively. Thereafter, the backrest member 504 is lifted upwards away from the rear connecting member 534*c* thus causing the seat member 502 to pivot parallel relative to the backrest member 504 and the front support frame 522, rear support frame 532, and armrest frame 506 all to lie in a flat compact configuration (as shown in FIG. 7).

Figure 7:
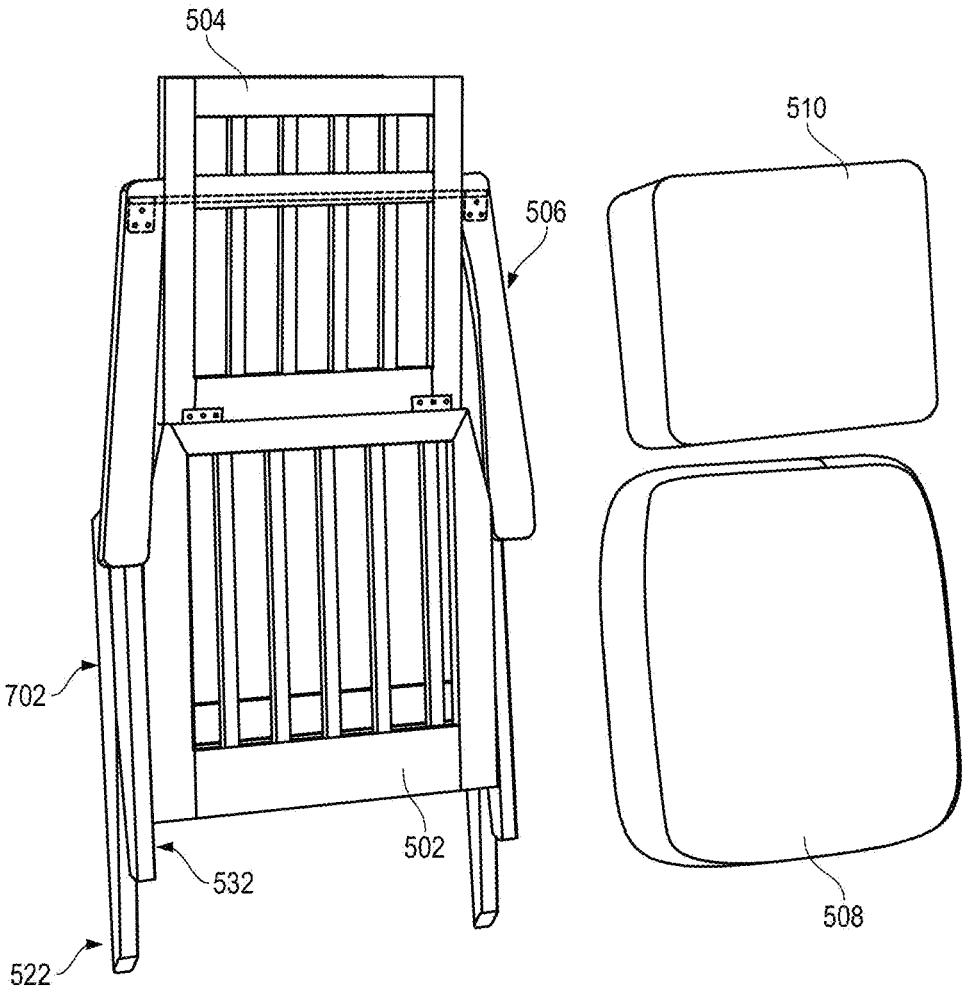
FIG. 7 is a schematic representation of the seating apparatus of FIG. 5A operated in a folded condition, in accordance with an embodiment of the present disclosure.

FIG. 7 illustrates a schematic representation of the seating apparatus 500 operated in the folded condition 702, in accordance with an embodiment of the present disclosure. In the folded condition 702, the seat member 502 is positioned in line with and adjacent to the backrest member 504, and the rear support frame 532 and the front support frame 522 are positioned on top of each other. The functionality of the seating apparatus 500 (i.e., the operation of the seating apparatus 500 between the unfolded condition 520 and the folded condition 702) is similar to the seating apparatus 100, therefore itis not reiterated herein for the sake of brevity.

Figure 8B:
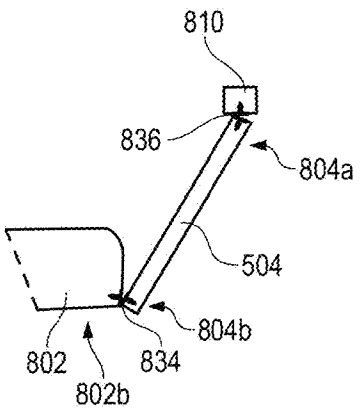
FIG. 8B illustrates a sectional view of the seating apparatus of FIG. 8A depicting the pivotal coupling of a seat member and a backrest member of the seating apparatus of FIG. 8A, in accordance with an embodiment of the present disclosure.
Figure 8A:
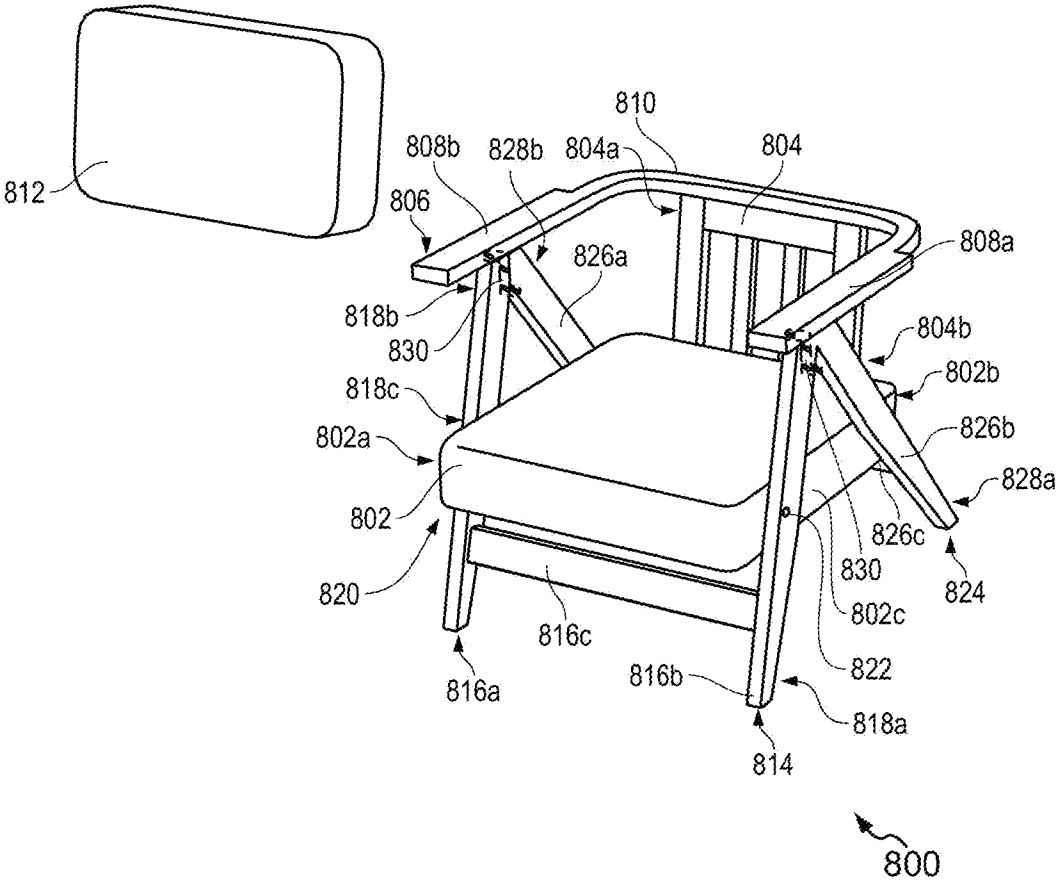
FIG. 8A illustrates a perspective view of a seating apparatus, in accordance with an embodiment of the present disclosure.

FIG. 8A illustrates a schematic representation of a seating apparatus 800, in accordance with an embodiment of the present disclosure. The seating apparatus 800 includes a seat member 802, a backrest member 804, and an armrest frame 806. The seat member 802 may be upholstered. The backrest member 804 may be made of wooden materials. Alternatively, the seat member 802 and the backrest member 804 may be made using metal, or any other materials as per the design feasibility and requirements. Further, the seating apparatus 800 includes a padded backrest 812. The padded backrest 812 is removably positioned on the backrest member 804. The upholstered seat 802 and the padded backrest 812 provide comfort to a user seated in the seating apparatus 800.

As shown, the backrest member 804 is pivotally mounted to the seat member 802 via a first mounting means (see, 834 of FIG. 8B). For example, the mounting means 834 may include hinges. In particular, the backrest member 804 includes a top portion 804*a* and a bottom portion 804*b*. The seat member 802 includes a front portion 802*a* and a rear portion 802*b*. The rear portion 802*b* of the seat member 802 is pivotally hinged to the bottom portion 804*b* of the backrest member 804. In an embodiment, the seat member 802 and the backrest member 804 may be pivotally coupled to each other using articulating arms, spring hinges, linkage systems, swivel joints, and the like.

The armrest frame 806 includes a left armrest member 808*a*, a right armrest member 808*b*, and at least one connecting member 810 connecting the left armrest member 808*a* and the right armrest member 808*b*. The armrest frame 806 may be made of wood, or any other materials as per design requirement. The connecting member 810 is pivotally mounted to the top portion 804*a* of the backrest member 804 using a second mounting means (see, 836 of FIG. 8B). For example, the second mounting means 836 may include hinges. Further, the connecting member 810, the left armrest member 808*a*, and the right armrest member 808*b* form a unitary structure. Further, the armrest frame 806 forms a U-shaped configuration.

The seating apparatus 800 further includes a front support frame 814. The front support frame 814 may be made of wood, or any other materials as per design requirement. The front support frame 814 includes a left front support structure 816*a*, a right front support structure 816*b*, and at least one front connecting member 816*c*. The front connecting member 816*c* connects the left front support structure 816*a* and the right front support structure 816*b*. In particular, the front connecting member 816*c* is mounted proximate to a bottom portion 818*a* of each of the left front support structure 816*a* and the right front support structure 816*b*. In an embodiment, the front connecting member 816*c* is mounted proximate to an intermediate portion 818*c* of each of the left front support structure 816*a* and the right front support structure 816*b*. The front connecting member 816*c* ensures the stability of the left front support structure 816*a* and the right front support structure 816*b* while the seating apparatus 800 is operated between the folded condition 1002 and the unfolded condition 520. Further, the left front support structure 816*a* and the right front support structure 816*b* are pivotally mounted to the left armrest member 808*a* and the right armrest member 808*b*, respectively. Specifically, a top portion 818*b* of each of the left front support structure 816*a* and the right front support structure 816*b* are pivotally mounted to the left armrest member 808*a* and the right armrest member 808*b*, respectively. Further, the intermediate portion 818*c* of each of the left front support structure 816*a* and the right front support structure 816*b* is adapted to be pivotally coupled to a pivot point 822 defined in a left side surface 802*c* and a right side surface 802*d* proximate to the front portion 802*a* of the seat member 802, respectively.

Further, the seating apparatus 800 includes a rear support frame 824. The rear support frame 824 may be made of wood, metal, or any other materials as per design requirements. The rear support frame 824 includes a left rear support structure 826*a*, a right rear support structure 826*b*, and at least one rear connecting member 826*c*. The rear connecting member 826*c* connects the left rear support structure 826*a* and the right rear support structure 826*b*. In particular, the rear connecting member 826*c* is mounted proximate to a bottom portion 828*a* of each of the left rear support structure 826*a* and the right rear support structure 826*b*. The rear connecting member 826*c* supports the rear portion 802*b* of the seat member 802 while the seating apparatus 800 is operated in the unfolded condition 820. Further, the left rear support structure 826*a* and the right rear support structure 826*b* are pivotally coupled to the left front support structure 816*a* and the right front support structure 816*b*, respectively. Specifically, a top portion 828*b* of each of the left rear support structure 826*a* and the right rear support structure 826*b* are pivotally mounted to the top portion 818*b* of each of the left front support structure 816*a* and the right front support structure 816*b*, respectively.

The seating apparatus 800 further includes a mounting member 830 and a mounting member 832. The mounting member 830 and the mounting member 832 are similar to the first mounting member 216. The mounting member 830 pivotally couples the left front support structure 816*a*, the left rear support structure 826*a*, and the left armrest member 808*a* via the fastening members. The mounting member 832 pivotally couples the right front support structure 816*b*, the right rear support structure 826*b*, and the right armrest member 808*b* via the fastening members. The pivotal coupling of the mounting members 830 and 832 are already explained with reference to FIG. 2A, therefore it is not reiterated herein for the sake of brevity. Alternatively, the second mounting member 220 may be used in the seating apparatus 800 for pivotally coupling the left front support structure 816*a*, the left rear support structure 826*a*, and the left armrest member 808*a*, and pivotally coupling the right front support structure 816*b*, the right rear support structure 826*b*, and the right armrest member 808*b*.

Figure 9:
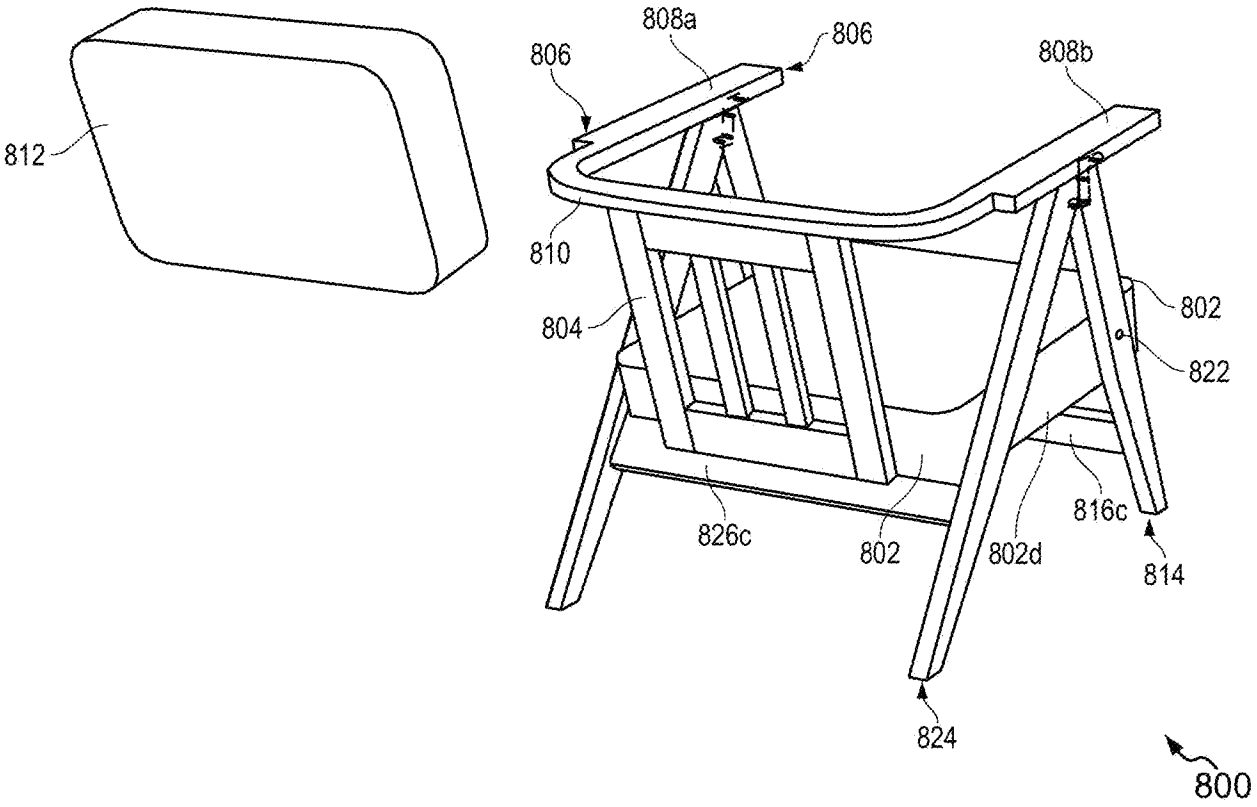
FIG. 9 is a rear perspective view of the seating apparatus of FIG. 8A, in accordance with an embodiment of the present disclosure.

Referring to FIG. 9 in conjunction with FIG. 8A, the seating apparatus 500 is configured to be operated between the unfolded condition 820 and the folded condition 1002 due to the pivotal movement of the seat member 802, the backrest member 804, the armrest frame 806, the front support frame 814, and the rear support frame 824. In the unfolded condition 820, the rear portion 802*b* of the seat member 802 is supported on the rear connecting member 826*c* (as shown in FIG. 9). For operating the seating apparatus 800 in the folded condition 1002, the padded backrest 812 is removed from the backrest member 804. Thereafter, the backrest member 804 is lifted upwards away from therear connecting member 826*c* thus causing the seat member 802 to pivot to a parallel position relative to the backrest member 804.

Figure 10:
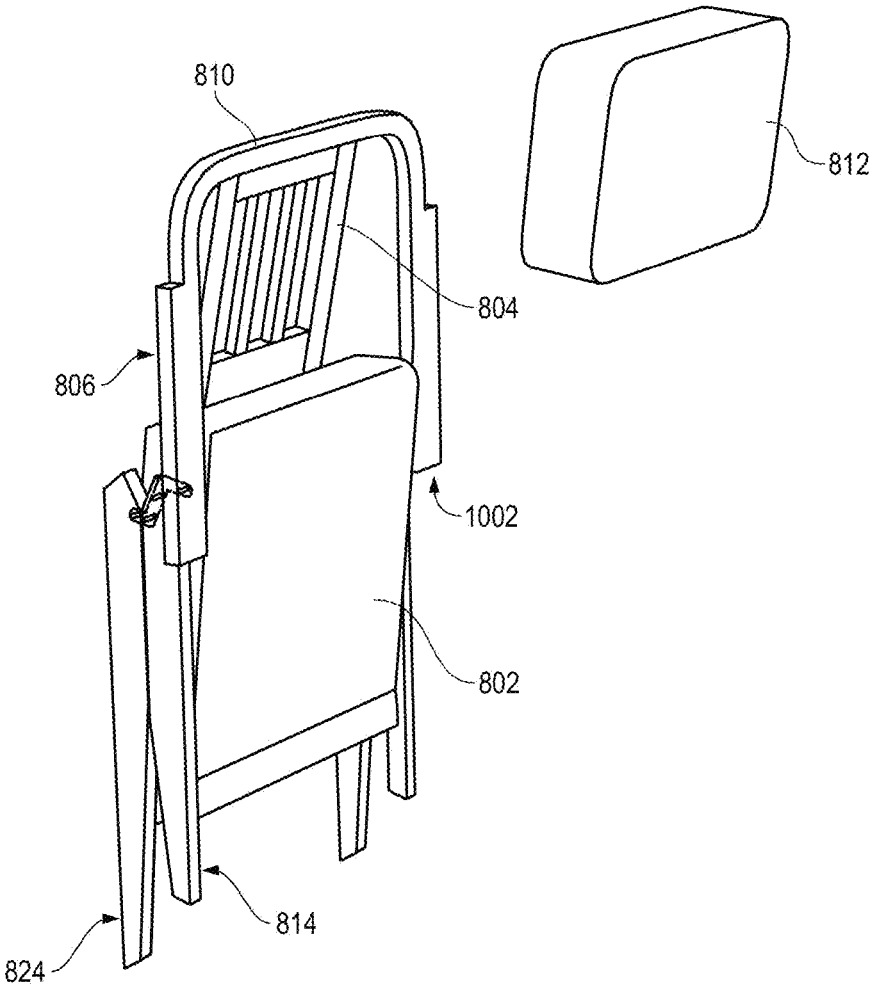
FIG. 10 is a schematic representation of the seating apparatus of FIG. 8A operated in a folded condition, in accordance with an embodiment of the present disclosure.

FIG. 10 illustrates a schematic representation of the seating apparatus 800 operated in the folded condition 1002, in accordance with an embodiment of the present disclosure. In the folded condition 1002, the seat member 802 is positioned adjacent to the backrest member 804 in a linear configuration, and the rear support frame 824 and the front support frame 814 are positioned on top of each other. The functionality of the seating apparatus 800 (i.e., the operation of the seating apparatus 800 between the unfolded condition 820 and the folded condition 1002) is similar to the seating apparatus 100 and the seating apparatus 500, therefore it is not reiterated herein for the sake of brevity.

Various embodiments of the present disclosure offer multiple advantages and technical effects. The folding mechanisms (such as the first mounting provision, the second mounting provision, and the connecting member) of the seating apparatus are not exposed in the seating apparatus. This enhances the aesthetic appeal of the seating apparatus. Further, the seating apparatus is configured to be folded in a compact flat configuration to enable ease of transportation and storage. The pivotal connection of each of the components in the seating apparatus provides ease in operating the seating apparatus between a folded condition and an unfolded condition.

Various embodiments of the disclosure, as discussed above, may be practiced with steps and/or operations in a different order, and/or with hardware elements in configurations, which are different than those which are disclosed. Therefore, although the disclosure has been described based upon these exemplary embodiments, it is noted that certain modifications, variations, and alternative constructions may be apparent and well within the spirit and scope of the disclosure.

Although various exemplary embodiments of the disclosure are described herein in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. A seating apparatus, comprising:

a seat member comprising a front portion and a rear portion;

an armrest frame comprising a left armrest member, a right armrest member, and at least one connecting member rigidly connecting the left armrest member to the right armrest member;

a backrest member comprising a top portion and a bottom portion, wherein the bottom portion of the backrest member is pivotally mounted to the rear portion of the seat member, and the top portion of the backrest member is pivotally connected to the connecting member of the armrest frame;

a front support frame comprising a left front support structure, a right front support structure, and at least one front connecting member connecting the left front support structure and the right front support structure, wherein the left front support structure and the right front support structure are pivotally mounted to the left armrest member and the right armrest member, respectively, and wherein the front support frame is pivotally connected to the seat member, wherein each of the left front support structure and the right front support structure comprises an intermediate portion adapted to be coupled to a point defined on a left side surface and a right side surface proximate to the front portion of the seat member, respectively; and a rear support frame comprising a left rear support structure, a right rear support structure, and at least one rear connecting member connecting the left rear front support structure and the right rear support structure, wherein the left rear support structure and the right rear support structure are pivotally coupled to the left front support structure and the right front support structure, respectively, wherein the pivotal mounting of the bottom portion of the backrest member to the rear portion of the seat member, the pivotal connection of top portion of the backrest member to the connecting member of the armrest frame, the pivotal mounting of the left front support structure and the right front support structure to the left armrest member and the right armrest member, respectively, the pivotal connection of front support frame to the seat member, and the pivotal coupling of the left rear support structure and the right rear support structure to the left front support structure and the right front support structure, respectively, facilitate the seating apparatus to be operated in an unfolded condition and a folded condition, wherein the seating apparatus is operated to the folded condition by lifting the backrest member in an upward direction away from the at least one rear connecting member causing the seat member to be lifted into a position in line with the backrest member, thus causing a distal end of the armrest frame to pivot in the upward direction and allowing the front support frame and the rear support frame to pivot in a direction to align with the seat member and the backrest member in the folded condition, and wherein the armrest frame, the rear support frame, and the front support frame are positioned on top of each other, and aligned with the seat member and the backrest member in the folded condition, wherein the seating apparatus is operated to the unfolded condition by pushing the backrest member in a downward direction towards the seat member until the seat member is inclined relative to the backrest member to form a first orientation, thereby causing the distal end of the armrest frame to pivot in a direction parallel to the seat member and causing the front support frame and the rear support frame to pivot into a second orientation with the front portion of the seat member supported by the front support frame and the rear portion of the seat member supported by the at least one rear connecting member, and wherein the left armrest member and the right armrest member operate synchronously to prevent deformation of the seating apparatus while the seating apparatus is operating between the folded position and the unfolded position.

2. The seating apparatus as claimed in claim 1, wherein the first orientation between the seat member and the backrest member corresponds to a substantially L-shaped configuration, and wherein the second orientation between the front support frame and the rear support frame and the seat member is substantially A-shaped configuration.

3. The seating apparatus as claimed in claim 1, further comprising a first mounting member, the first mounting member comprising:

a first portion accommodated in a recessed slot configured in a bottom portion proximate to a proximal end of the left armrest member and the right armrest member, wherein the first portion of the left mounting bracket is pivotally coupled to the left armrest member and the right armrest member via a first set of fastening members;

a second portion accommodated in a recessed slot configured in a top portion of the left rear support structure and the right rear support structure, wherein the second portion of the first mounting member is pivotally coupled to the left rear support structure and the right rear support structure via the first set of fastening members; and a third portion connecting the first portion and the second portion, the third portion adapted to be accommodated in a recessed slot defined in the left front support structure and the right front support structure, wherein the third portion is mounted to the left front support structure and the right front support structure via the first set of fastening members.

4. The seating apparatus as claimed in claim 1, further comprising a second mounting member, the second mounting member comprising at least one first mounting plate and at least one second mounting plate, wherein, the at least one first mounting plate is configured to pivotally couple the top portion of the front support frame to a bottom portion of the armrest frame, wherein the at least one first mounting plate is coupled via a second set of fastening members to a recessed slot configured in the bottom portion of the left armrest member and the right armrest member, and a recessed slot configured in a top portion of the right front support structure and the left front support structure, and the at least one second mounting plate is configured to pivotally couple a top portion of the rear support frame to a top portion of the front support frame, wherein the at least one second mounting plate is coupled via the second set of fastening members to the recessed slot configured in the top portion of the right front support structure and the left front support structure, and a recessed slot configured in a top portion of the right rear support structure and the left rear support structure.

5. The seating apparatus as claimed in claim 1, wherein the backrest member and the seat member are upholstered.

6. The seating apparatus as claimed in claim 1, wherein the at least one connecting member integrally coupled to the left armrest member and the right armrest member is concealed within the backrest member.

7. The seating apparatus as claimed in claim 1, wherein the at least one connecting member integrally coupled to the left armrest member and the right armrest member forms a U-shape unitary configuration of the armrest frame.

8. The seating apparatus as claimed in claim 1, further comprising a connecting bracket, the connecting bracket comprising a first end pivotally mounted to the at least one rear connecting member and a second end pivotally mounted to a bottom portion of the seat member, wherein the connecting bracket facilitates the pivotal movement of the rear support frame for positioning the rear support frame parallel to the seat member and adjacent to the front support frame while the seating apparatus is operated in the folded condition, and facilitates the pivotal movement of the rear support frame for positioning the rear support frame in the second orientation relative to the front support frame while the seating apparatus is operated in the unfolded condition.

9. The seating apparatus as claimed in claim 1, wherein the point is a pivot point, and wherein the intermediate portion of each of the left front support structure and the right front support structureis adapted to be pivotally coupled to the pivot point defined on the left side surface and the right side surface proximate to the front portion of the seat member, respectively.

10. The seating apparatus as claimed in claim 1, wherein the backrest member comprises a crossbar defined with a groove for receiving the at least one connecting member of the armrest frame.

* * * * *